US007231053B2

(12) United States Patent
Polk, Jr.

(10) Patent No.: US 7,231,053 B2
(45) **Date of Patent: *Jun. 12, 2007**

(54) ENHANCED MULTI-CHANNEL AUDIO SURROUND SOUND FROM FRONT LOCATED LOUDSPEAKERS

(75) Inventor: Matthew S. Polk, Jr., Gibson Island, MD (US)

(73) Assignee: Britannia Investment Corp., San Diego, CA (US)

( * ) Notice: Subject to any disclaimer, the term of this patent is extended or adjusted under 35 U.S.C. 154(b) by 16 days.

This patent is subject to a terminal disclaimer.

(21) Appl. No.: 11/147,447

(22) Filed: Jun. 8, 2005

(65) Prior Publication Data

US 2005/0226425 A1 Oct. 13, 2005

Related U.S. Application Data

(63) Continuation-in-part of application No. 10/692,692, filed on Oct. 27, 2003, now Pat. No. 6,937,737.

(51) Int. Cl.
*H04R 5/02* (2006.01)

(52) U.S. Cl. ..... 381/300; 381/27; 381/307

(58) Field of Classification Search ..... 381/300, 381/307, 309, 310, 17–19, 1, 21, 345, 332, 381/386, 27

See application file for complete search history.

(56) References Cited

U.S. PATENT DOCUMENTS 4,199,658 A 4/1980 Iwahara
4,489,432 A 12/1984 Polk
4,497,064 A 1/1985 Polk
4,569,074 A 2/1986 Polk
4,630,298 A 12/1986 Polk et al.
4,748,669 A 5/1988 Klayman
4,847,904 A 7/1989 McShane
4,893,342 A 1/1990 Cooper et al.
4,910,779 A 3/1990 Cooper et al.
4,975,954 A 12/1990 Cooper et al.
5,034,983 A 7/1991 Cooper et al.
5,117,459 A 5/1992 McShane
5,136,651 A 8/1992 Cooper et al.
5,263,086 A 11/1993 Yamazaki
5,265,166 A 11/1993 Madnick et al.

(Continued)

*Primary Examiner*—Brian Tyrone Pendleton
*Assistant Examiner*—Con P Tran
(74) *Attorney, Agent, or Firm*—Sterne, Kessler, Goldstein & Fox P.L.L.C.

(57) ABSTRACT

In a loudspeaker system with main and sub-speakers, a modified and inverted left surround signal is added to the signals driving the right main speaker and a modified and inverted right surround signal is added to the signals driving the Left Main Speaker for the purpose of creating more credible rear located phantom sound images. In a system using variations of a difference signal to create phantom rear located sound images, the components of the difference signal are modified by introducing a time delay to one of the components for the purpose of preventing the components of the difference signal from substantially canceling each other. The components of the difference signal may be modified by altering the relative level and frequency response of the components for the purpose of preventing the components of the difference signal from substantially canceling each other. In a system using variations of the difference signal to create phantom sound images, cost effective means are provided to isolate individual amplifier channels so as to block potentially damaging current flows without degrading performance.

15 Claims, 8 Drawing Sheets

U.S. PATENT DOCUMENTS 5,333,200 A 7/1994 Cooper et al.
5,438,623 A 8/1995 Begault
5,459,790 A 10/1995 Scofield et al.
5,533,129 A 7/1996 Gefvert
5,579,396 A 11/1996 Iida et al.
5,581,618 A 12/1996 Satoshi et al.
5,590,204 A 12/1996 Lee
5,594,801 A 1/1997 McShane
5,598,478 A 1/1997 Tanaka et al.
5,684,881 A 11/1997 Serikawa et al.
5,703,955 A 12/1997 Fels et al.
5,740,253 A 4/1998 Takeuchi
5,799,094 A 8/1998 Mouri
5,822,438 A 10/1998 Sekine et al.
5,850,457 A * 12/1998 Gefvert ..... 381/300
5,912,976 A 6/1999 Klayman et al.
6,026,169 A 2/2000 Fujimori
6,052,470 A 4/2000 Mouri
6,160,894 A 12/2000 Kishigami et al.
6,173,061 B1 1/2001 Norris et al.
6,243,476 B1 6/2001 Gardner
6,307,941 B1 10/2001 Tanner, Jr. et al.
6,381,335 B2 * 4/2002 Juszkiewicz et al. ..... 381/306
6,424,719 B1 7/2002 Elko et al.
6,633,648 B1 10/2003 Bauck

* cited by examiner

ENHANCED MULTI-CHANNEL AUDIO SURROUND SOUND FROM FRONT LOCATED LOUDSPEAKERS

CROSS REFERENCE TO RELATED APPLICATIONS

This application is a continuation-in-part of application Ser. No. 10/692,692, filed Oct. 27, 2003 now U.S. Pat. No. 6,937,737, the entirety of which is incorporated herein by reference.

BACKGROUND OF THE INVENTION

1. Field of the Invention

This invention relates generally to the reproduction of sound in multi-channel systems generically known as "surround-sound" systems and more specifically to the application of psychoacoustic principles in the design of a loudspeaker system for reproducing a surround sound experience from loudspeakers located only in front of the listener.

2. Background Art

One problem which is common to all methods of producing phantom rear located sound images from a sound source or sources located in front of the listener is that the phantom source illusion tends to collapse as the listener turns or moves the listener's head even slightly. This problem arises from fundamental differences in the way sound at the listener's two ears changes as the head turns in relation to the location of a sound source in front of the listener as compared to a rear located sound source. For example, for a front located sound source not on the median plane (i.e., the vertical plane equidistant from the listener's two ears.), the interaural time delay ITD for sound arriving at the listener's ear nearest the sound source relative to the arrival time of the sound at the ear farthest from the sound source will decrease as the listener turns toward the sound source. Similarly, the interaural level difference ILD between the listener's two ears will also decrease as the listener turns toward the sound source. Both the ITD and ILD will be zero when the listener faces directly toward the sound source. In comparison, for a sound source located behind the listener, the ITD will increase as the listener turns towards the sound source and will reach a maximum when the listener has turned such that the sound source is located directly to one side, 90 degrees from the median plane. In general, the ILD will also increase as the listener turns towards a rear located sound source and will reach a maximum when the sound source is located directly to one side. However, as is well known, the behavior of the ILD at individual frequencies is complex and may not follow this general rule.

A second problem arises specifically in systems which use variations of a difference signal to create phantom rear located sound images such as is described in parent application Ser. No. 10/692,692. Difference signals are formed by subtracting one audio signal from a second audio signal. Referring to FIG. 1 herein, which corresponds to FIG. 2*a* of parent application Ser. No. 10/692,692, a device is shown for reproducing surround sound from front located speakers. In this device, left and right sub-speakers LSS and RSS receive difference signals (LS'−RS') and (RS'−LS'), respectively. These difference signals are developed from the left and right surround signals LS and RS for the purpose of creating phantom rear sound images as described in more detail the parent application. However, whenever the two components of the difference signal are the same, the components substantially cancel each other and the difference signal becomes zero. In such a device, when the difference signal drops close to zero the device becomes much less effective in creating phantom rear located sound images. Unfortunately, this situation may occur quite often. For example, in surround systems using Dolby® Pro-Logic® decoding, both rear channels carry the same signal. Many two channel to five channel music surround schemes also use monaural rear channel signals. The situation also occurs in discrete five channel systems when the rear image is intended to be located directly behind the listener. This last situation is, of course, well known as one of the most difficult phantom images to produce.

An additional problem is encountered in systems using passive methods to develop a difference signal by modifying and combining the speaker level output of two or more amplifier channels. Such a system is disclosed in U.S. Pat. Nos. 4,683,505 and 4,759,066 to Polk, et al. As is disclosed in these patents, amplifier channels which do not share a common ground may be damaged if DC current flows are permitted from one channel to the other. However, the methods proposed for isolation of the channels involve costly transformers which may also degrade performance.

BRIEF SUMMARY OF THE INVENTION

In accordance with one embodiment of the present invention, in a system with main and sub-speakers, such as disclosed in parent application Ser. No. 10/692,692, a modified and inverted left surround signal is added to the signals driving the right main speaker and a modified and inverted right surround signal is added to the signals driving the left main speaker for the purpose of creating more credible rear located phantom sound images.

In accordance with another embodiment of the present invention, in a system using variations of a difference signal to create phantom rear located sound images, such as disclosed in parent application Ser. No. 10/692,692, the components of the difference signal are modified by introducing a time delay to one of the components for the purpose of preventing the components of the difference signal from substantially canceling each other.

In accordance with another embodiment of the present invention, in a system using variations of a difference signal to create phantom rear located sound images, such as disclosed in parent application Ser. No. 10/692,692, the components of the difference signal are modified by altering the relative level and frequency response of the components for the purpose of preventing the components of the difference signal from substantially canceling each other.

In accordance with yet another embodiment of the present invention, in a system using variations of the difference signal to create phantom sound images cost effective means are provided to isolate individual amplifier channels so as to block potentially damaging current flows without degrading performance.

BRIEF DESCRIPTION OF THE DRAWINGS/FIGURES

Figure 2:
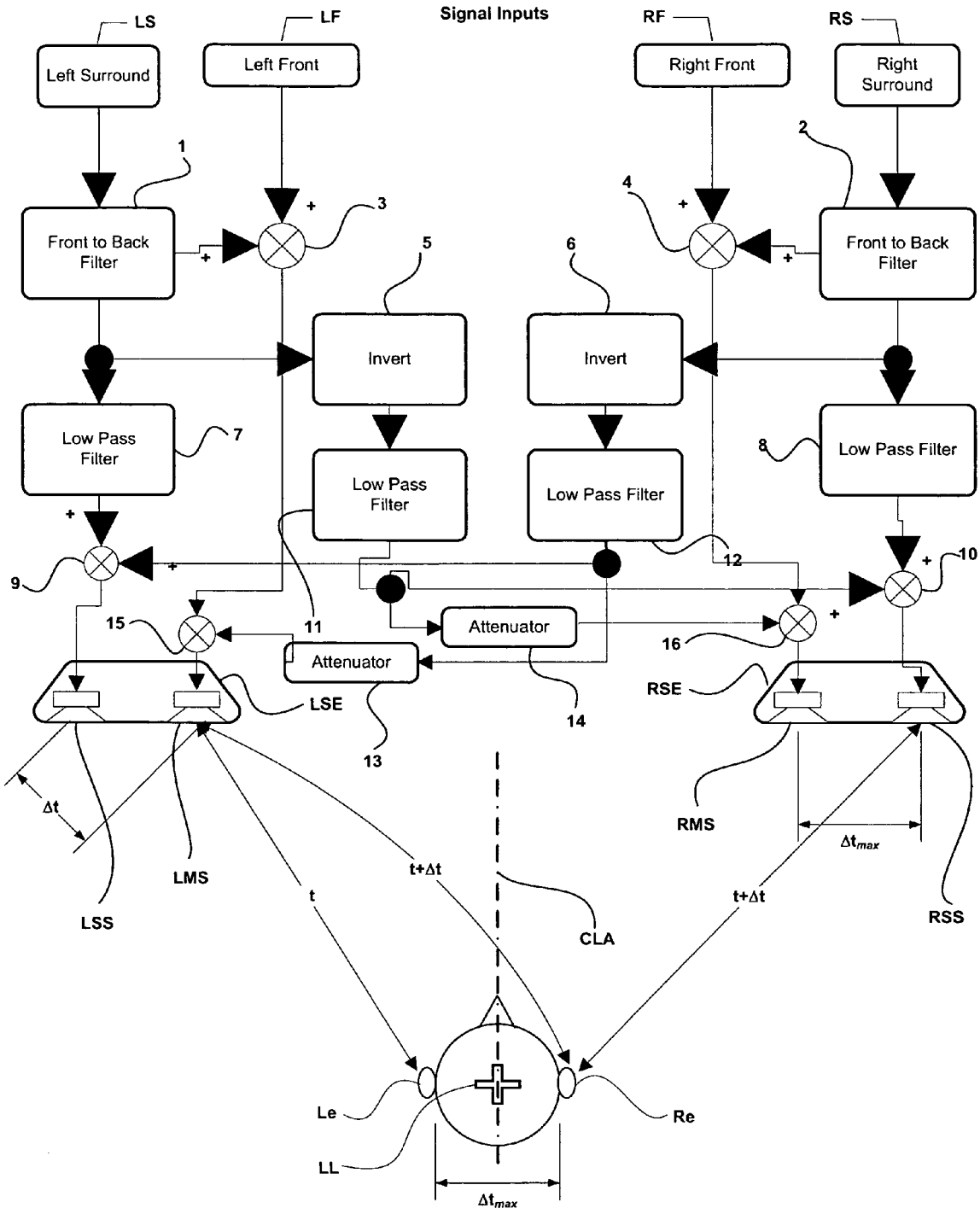
FIG. 2 is a diagram showing a first embodiment of the present invention.
Figure 2A:
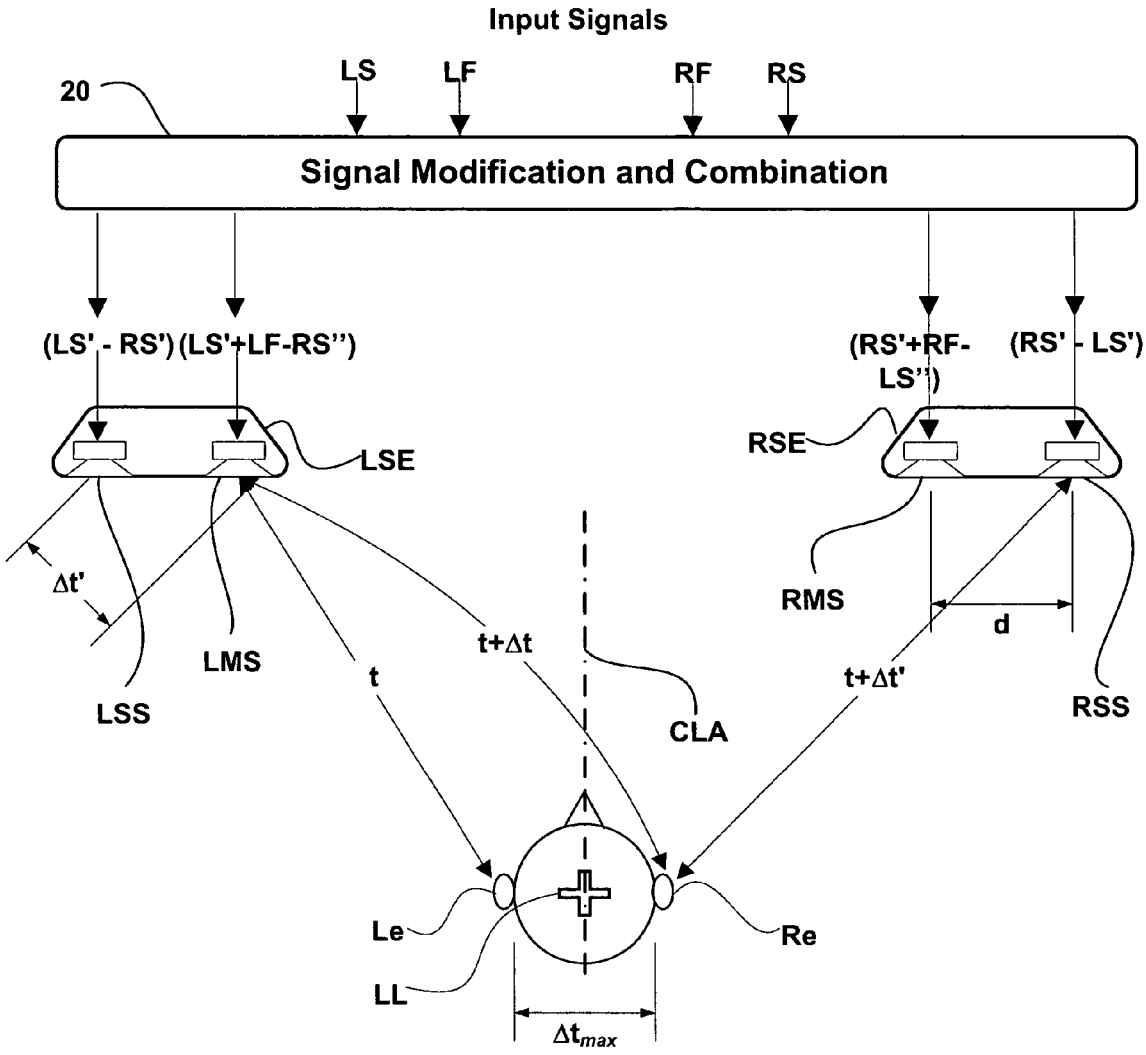

FIG. 2*a* is a diagram showing the signal combinations of a first embodiment of the present invention.

Figure 3:
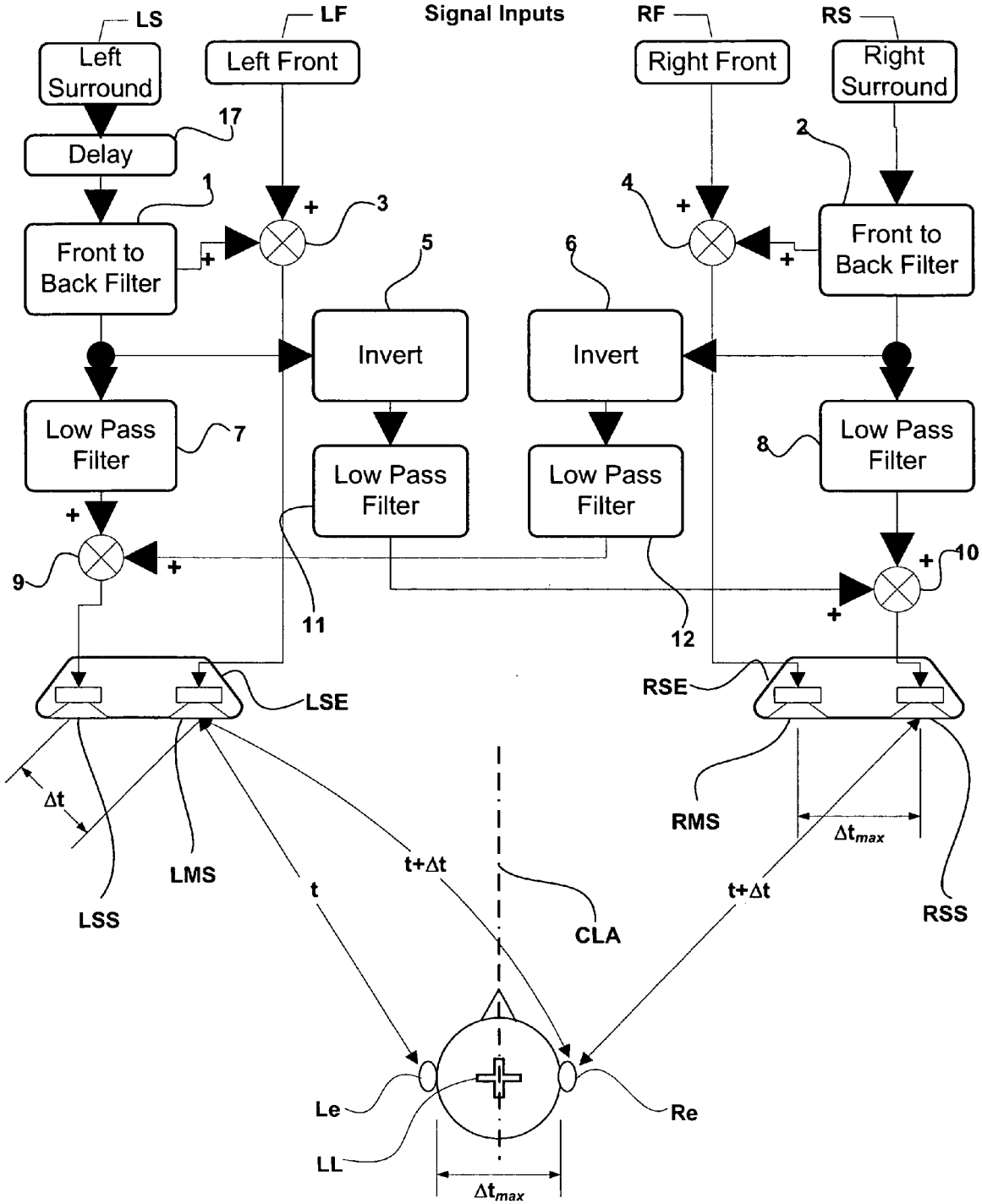

FIG. 3 is a diagram showing a second embodiment of the invention.

Figure 4:
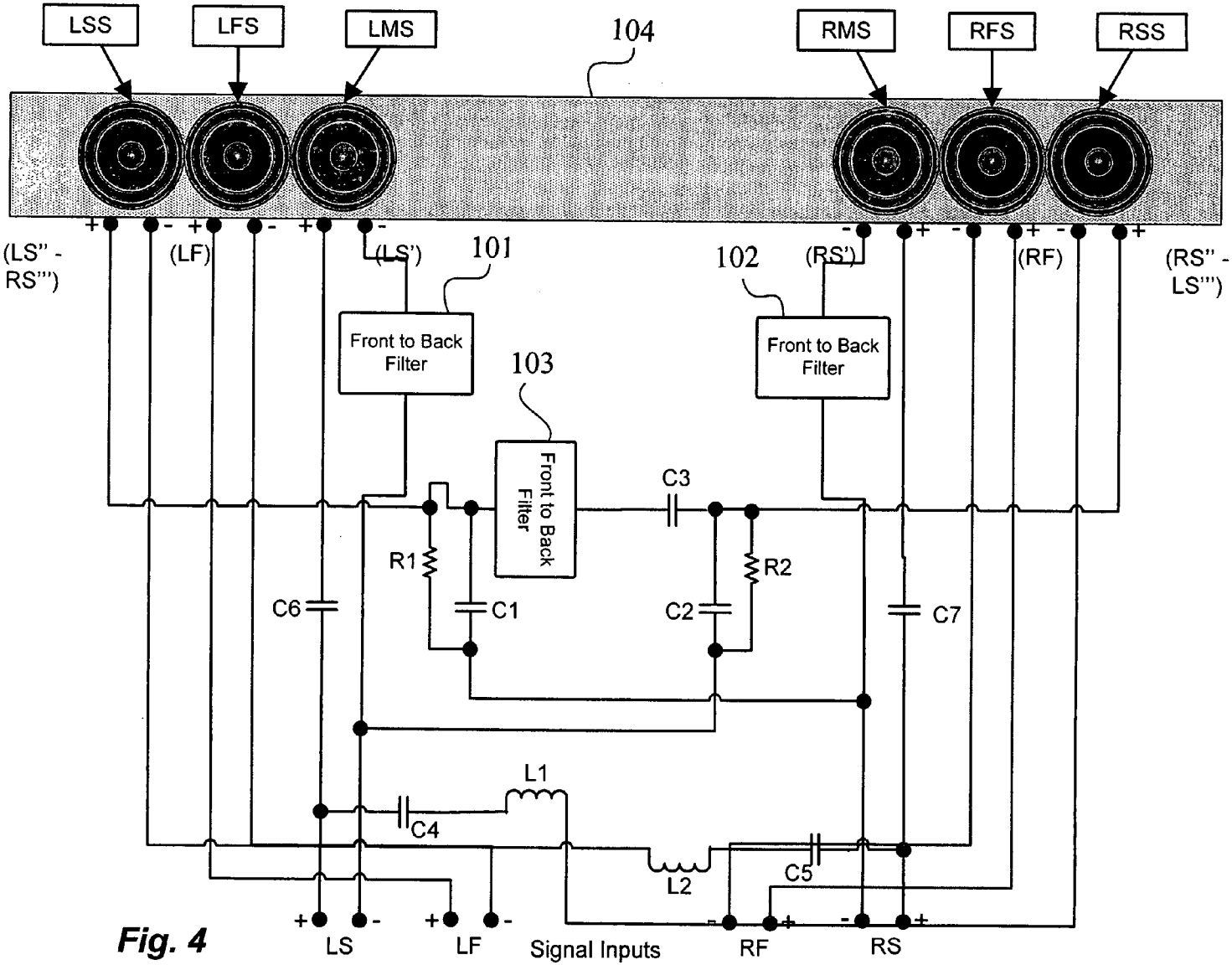

FIG. 4 is a diagram showing a third embodiment of the invention.

Figure 4A:
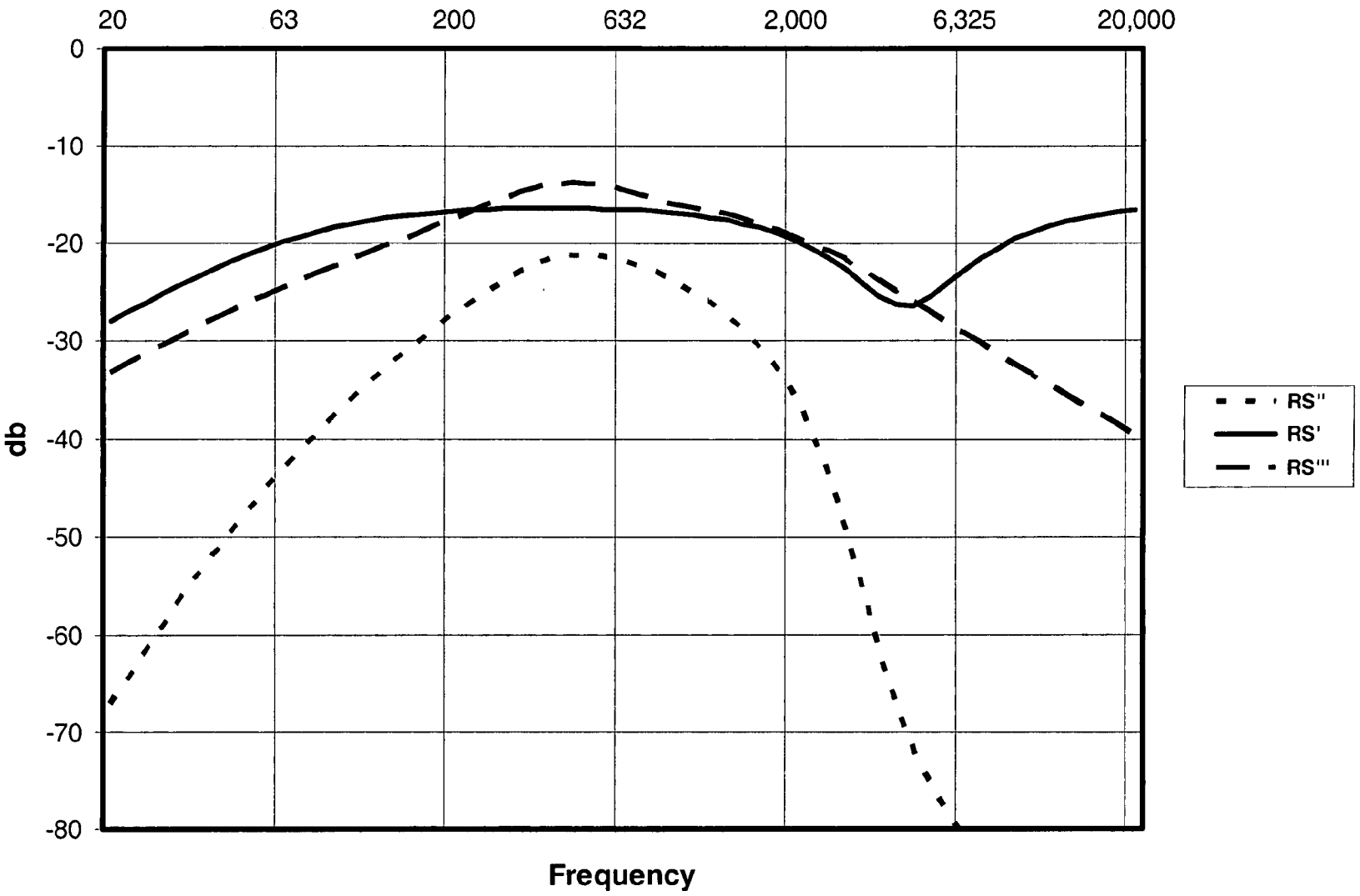

FIG. 4*a* is a chart of the relative magnitude and frequency response of various signals developed in the third embodiment of the invention.

Figure 5:
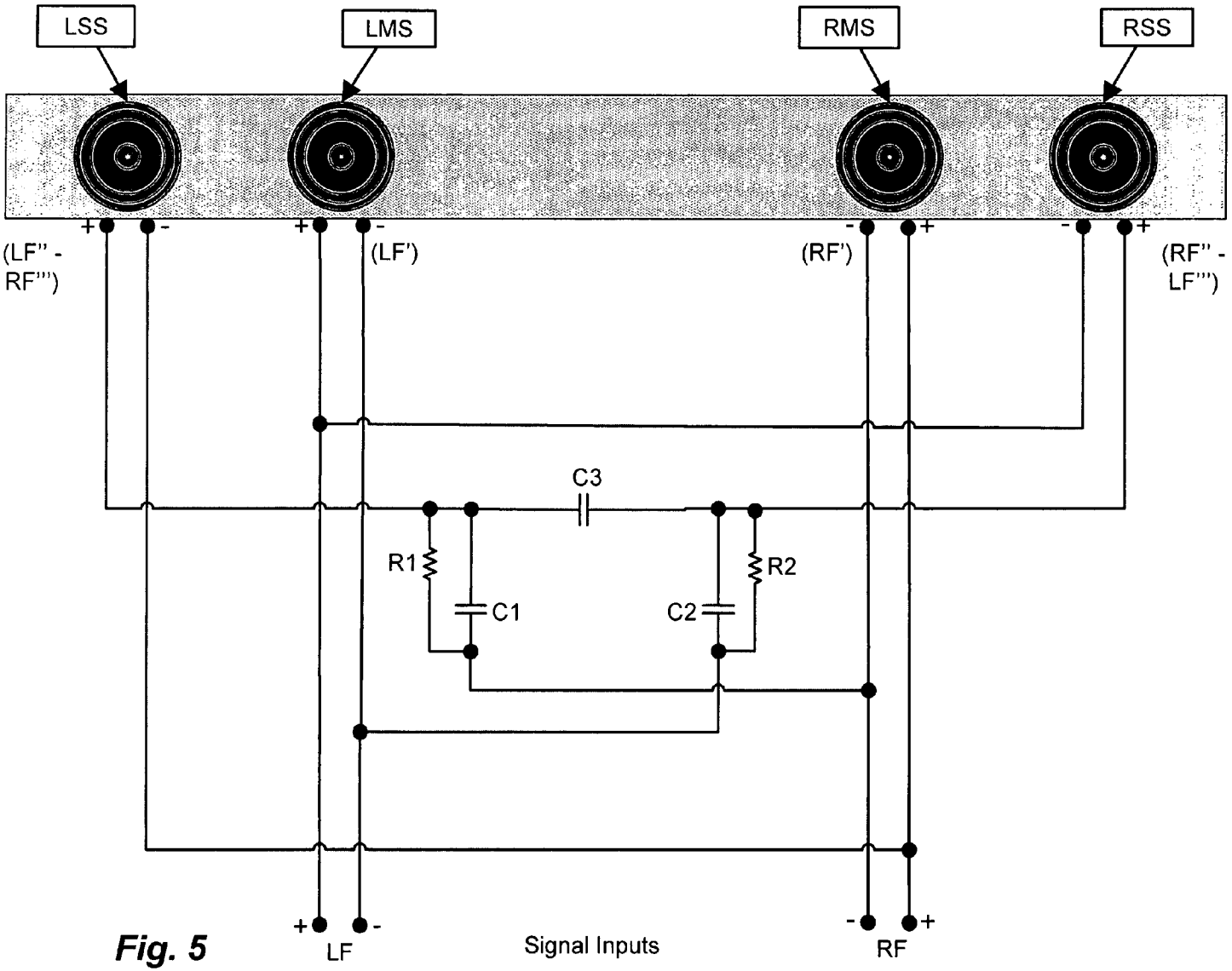

FIG. 5 is a diagram showing a simplified implementation of the third embodiment of the invention.

DETAILED DESCRIPTION OF THE INVENTION

Preferred embodiments of the present invention are now described with reference to the figures where like reference characters/numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention.

FIG. 2 and FIG. 2*a* show a first preferred embodiment of the present invention. FIG. 2 shows the device of an embodiment shown in parent application Ser. No. 10/692,692, specifically FIG. 2, for generating surround sound from front located loudspeakers, with the addition of signal attenuators 13 and 14, and mixers 15 and 16. Referring to FIG. 2*a* the addition of the signal components, −RS" and −LS" is shown diagrammatically.

As described in the parent application, four audio signal inputs, for example only and not by way of limitation, corresponding to signal channels of a surround sound system are provided. It is understood that these may be any four audio input signals. However, for purposes of clarity and consistency these signals will be referred to herein as left surround signal LS; left front signal LF; right front signal RF; and right surround signal RS. Left and right loudspeaker enclosures, LSE and RSE are also provided. Left loudspeaker enclosure LSE contains at least one left main speaker LMS and at least one left sub-speaker LSS. Right loudspeaker enclosure RSE contains at least one right main speaker RMS and at least one right sub-speaker RSS. As is well known by those skilled in the art unmodified audio signals reproduced by a pair of loudspeakers, such as in a typical stereo audio system, are perceived by a listener sitting in front of the speakers as originating from a range of sound locations between the two loudspeakers. Therefore, sounds produced only by main left and right loudspeakers LMS and RMS are perceived by a listener located at principle listening location LL as originating from a range of sound locations approximately between and bounded by the actual locations of left and right main loudspeakers LMS and RMS.

As shown in FIG. 2, a listener located at principle listening location LL has a left ear Le and a right ear Re. The midpoint between the left ear Le and the right ear Re is located along a central listening axis CLA. As noted in U.S. Pat. No. 4,489,432, incorporated in its entirety by reference herein, the right and left ear locations are separated by a maximum interaural sound distance of $\Delta t_{max}$. As also explained in U.S. Pat. No. 4,489,432, and shown in FIG. 2, sound distance t is the time for sound from the left main speaker LMS to reach the left ear Le and sound distance $t+\Delta t$ is the time for sound from the left main speaker LMS to reach the right ear Re. Similarly, sound distance t is also the time required for sound from right main speaker RMS to reach right ear Re and sound distance $t+\Delta t$ is also the time for sound from the right main speaker RMS to reach the left ear Le In similar fashion, $t+\Delta t$ is also the time for sound from the right sub-speaker RSS to reach the right ear Re, and the time for sound from the left sub-speaker LSS to reach the left ear Le.

Referring again to FIG. 2, left surround signal LS passes through front-to-back filter 1 and is combined with left front signal LF in adder 3. The combined signal is then transmitted to left main speaker LMS. Similarly, right surround signal RS passes through front-to-back filter 2 and is combined with right front signal RF in adder 4. The combined signal is then transmitted to right main speaker RMS.

Front-to-back filters 1 and 2 modify the surround signals LS and RS such that, at the listener's ears and over a certain frequency range, they will approximate the frequency response of sound signals as if they originated from the rear of the listener, even though they are being projected from the front of the listener. This modification is explained in parent application Ser. No. 10/692,293.

After passing through front-to-back filter 1, left surround signal LS passes through an inverter 5 and a low pass filter 11. It then passes through an adder 10, in which it is combined with right surround signal RS, which has passed through front-to-back filter 2 and low pass filter 8 such that the resulting combined signal is composed of a modified left surround signal LS' subtracted from a modified right surround signal RS'. The combined signal is then transmitted to right sub-speaker RSS, located in right speaker enclosure RSE. The improvement of this application is shown in FIG. 2, where left surround signal LS, after passing through front-to-back filter 1, inverter, 5, and low pass filter 11, is passed through attenuator 14 and added to modified right front signal RF in mixer 16. Similarly, after passing through front-to-back filter 2, right surround signal RS passes through an inverter 6 and a low pass filter 12. It then passes through an adder 9, in which it is combined with left surround signal LS, which has passed through front-to-back filter 1 and low pass filter 7 such that the resulting combined signal is composed of a modified right surround signal RS' subtracted from a modified left surround signal LS'. The combined signal is then transmitted to left sub-speaker LSS located in left speaker enclosure LSE. As described above, right surround signal RS, after passing through front-to-back filter 2, inverter 6, and low pass filter 12, is passed through attenuator 13, and then added to modified left front signal LF in mixer 15. Low pass filters 7, 8, 11 and 12 may have characteristics limiting the frequency response to below approximately 1 kHz, as disclosed in U.S. Pat. No. 4,630,298 generally for the purpose of stabilizing the apparent sound locations, improving tolerance to movements of the listener's head, improving the illusion of apparent sound locations for listeners not located at the principle listening location LL, and allowing greater tolerance in the location of the main and sub-speakers. However, in some implementations of the present invention it is desirable for said low pass filters to have frequency response extending substantially beyond 1 kHz or to select one cutoff frequency for low pass filters 7 and 8, and a different cutoff frequency for low pass filters 11 and 12. In one specific implementation of this embodiment of the present invention low pass filters 7 and 8 have a frequency response extending to approximately 5 kHz and low pass filters 11 and 12 have a frequency response extending up to approximately 1.8 kHz.

In accordance with this first embodiment, FIG. 2*a* shows the general composition of the modified and combined signals transmitted to each speaker where the prime designation, ', denotes that the original audio input signal has been suitably modified by signal modification and combination means 20. It will be understood that within the scope of the present invention and as shown in FIG. 2*a* that any suitable means may be employed to achieve the appropriate signal modifications and combinations. In addition and as discussed above, experiments have shown that within the scope of the present invention, many variations to the specific signal modifications herein described function to provide an acceptable surround sound illusion from loudspeakers located only in front of the listener. The specific signal modifications described herein are by way of example only and not of limitation.

Figure 1:
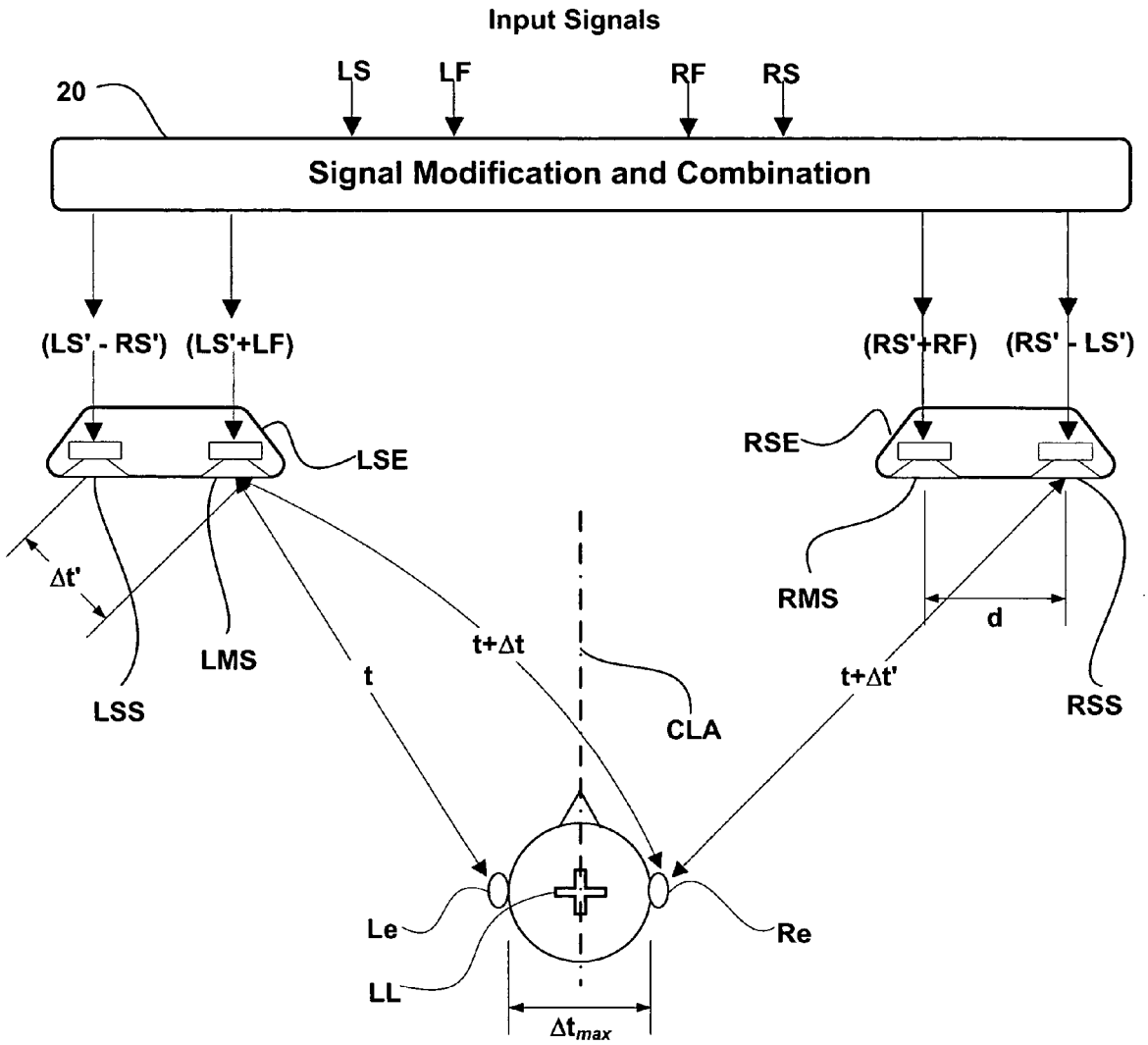
FIG. 1 is a general diagram of a device for creating surround sound from front located speakers corresponding to FIG. 2*a* of parent application Ser. No. 10/692,692.

In this first embodiment, left sub-speaker LSS and right sub-speaker RSS are positioned relative to left main speaker LMS and right main speaker RMS and to the listener according to the teachings of U.S. Pat. Nos. 4,489,432; 4,497,064; 4,569,074 and 4,630,298 for the purpose of canceling IAC and producing a realistic acoustic field extending beyond the loudspeaker locations. As shown in prior art FIG. 1, and discussed in the above-referenced U.S. patents, the left and right sub-speakers LSS and RSS may be located on a common speaker axis with left and right main speakers LMS and RMS. However, as also discussed in the above-referenced U.S. Pat. No. 4,497,064, the sub-speakers may be placed in any location that produces the correct time delay relative to the respective main speakers for sounds aiming at the listener's ears. As shown in FIG. 2 and discussed in U.S. Pat. Nos. 4,489,432; 4,497,064; and 4,569,074 in the case that the main and sub-speakers are located along a common speaker axis the preferred spacing between the respective main and sub-speakers on each side is approximately equal to the maximum interval sound $\Delta t_{max}$ up to approximately 150% of $\Delta t_{max}$ resulting in a corresponding variation in the inter-speaker delay $\Delta t'$ without departing from the spirit and function of the present invention. As shown in prior art FIG. 1, the methods disclosed in U.S. Pat. Nos. 4,489,432; 4,497,064; 4,569,074 and 4,630,298 are capable of creating apparent sound locations in a range of up to approximately 90 degrees left and right of central listening axis CLA in front of the listener from two audio input signals such as are present in a normal stereo recording. As previously described, in the first embodiment of the present invention, front-to-back filters 1 and 2 of FIG. 2 are selected to transform the frequency response of sound locations in front of the listener to approximate the frequency response at both of the listener's ear drums of sound locations at mirror image locations behind the listener over a defined frequency range. The methods disclosed in U.S. Pat. Nos. 4,489,432; 4,497,064; 4,569,074 and 4,630,298 modified as specified herein and in combination with the aforementioned signal manipulations will therefore create the illusion of sound locations in a range of approximately 90 degrees left and right of the central listening axis behind the listener from left and right surround input signals LS and RS.

Referring back to the addition of attenuators 13 and 14 and mixers 15 and 16 to the embodiment shown in FIG. 2, it has been found experimentally that the addition of these signals to a device constructed in accordance with parent application Ser. No. 10/692,692 gives the listener a more accurate simulation of the correct IAD and ILD for an actual rear located sound image as the listener turns his/her head in the direction of the phantom rear sound image. It has also been found experimentally that the addition of these signals with an attenuation of not less than 4 db substantially increases the range of listening locations from which the listener will perceive credible phantom rear images. In a specific embodiment of the present invention, the attenuators 13 and 14 provide 8 db of attenuation for the inverted signal components -RS" and -LS".

Figure 3A:
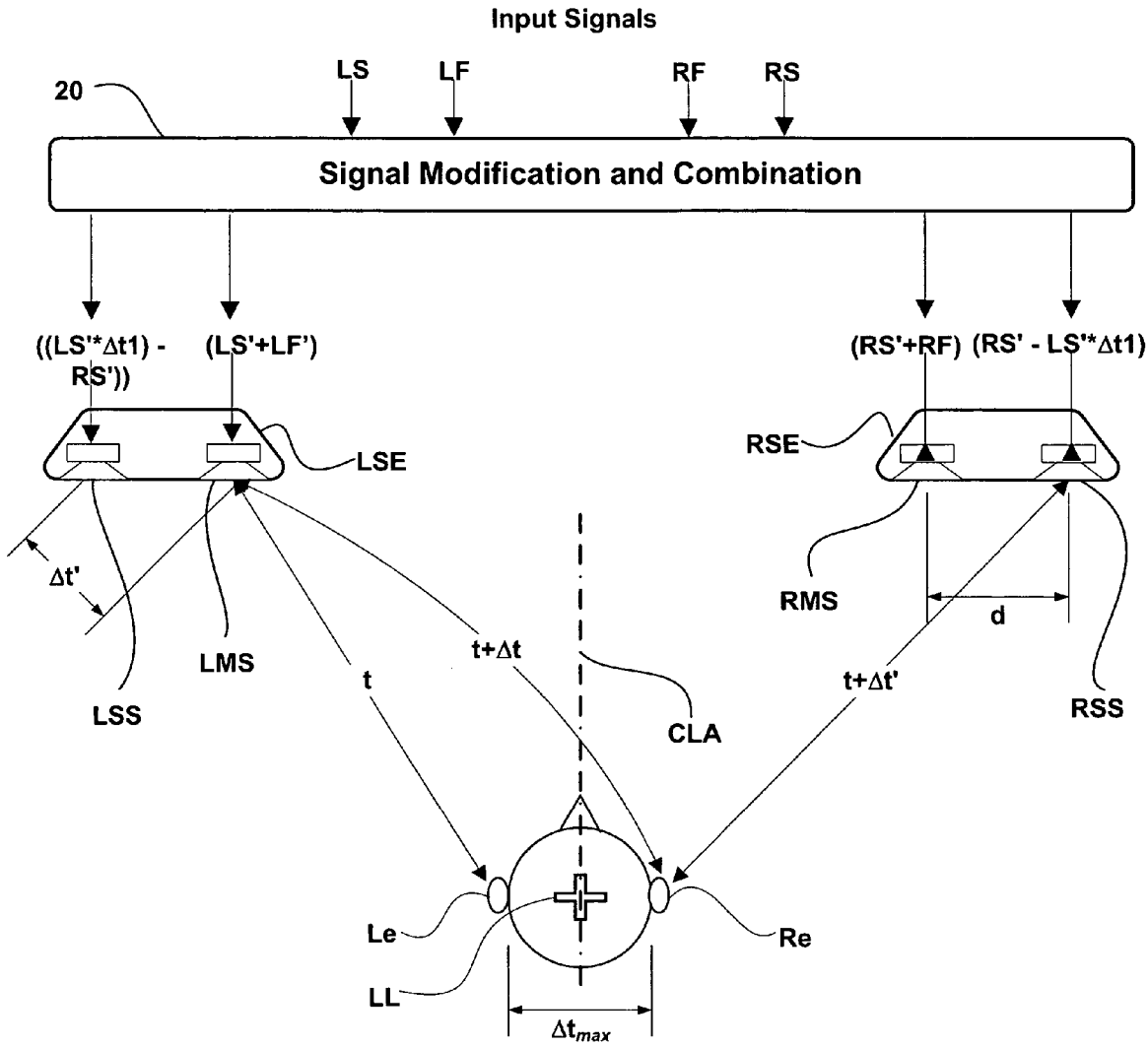

FIG. 3 shows a second embodiment of the present invention wherein a delay 17 is added in the signal path of the left surround signal LS in a device constructed in accordance with FIG. 2 of parent application Ser. No. 10/692,692. FIG. 3*a* shows diagrammatically the effect on the signals fed to left and right sub-speakers LSS and RSS by delaying the left surround signal LS by an amount of time equal to $\Delta t_1$. As can be easily seen by inspection, the introduction of the delay means that when left and right surround signals RS and LS are equal as in a Dolby® Pro-Logic® decoding scheme, the components of the difference signal being applied to the left and right sub-speakers LSS and RSS will not cancel and the difference signal will be non-zero. Therefore, the device will still function properly in the case of a monaural signal being received by right and left surround channels RS and LS.

It has been found experimentally that the introduction of a suitable relative delay between the two surround signals, RS and LS, produces phantom rear sound images which are more credible for the listener, particularly in the area directly behind the listener. This relative delay may be accomplished by delaying just one of the two surround signals, RS or LS, or by introducing delays of different magnitudes to the two surround channels, RS and LS, such that there is a relative delay between the two surround signals. In addition it has been found experimentally that phantom rear sound images intended to be perceived as moving behind the listener from one side to the other are perceived as moving in a more continuous fashion with an appropriate delay applied to either one, but not both, of the two surround signals. Further, it has been found experimentally that a delay in the range of 0.5 ms to 2.5 ms produces the best results. In a specific embodiment of the present invention the delay 17 of FIG. 3 is 1.5 ms and is applied to the left surround signal LS only.

FIG. 4 shows a third embodiment of the present invention wherein another method is used to insure that a non-zero difference signal is always applied to left and right sub-speakers LSS and RSS. Referring to FIG. 4, left and right front speakers LFS and RFS, left and right main speakers LMS and RMS, and left and right sub-speakers LSS and RSS, are all mounted within a single enclosure 104, such that the arrangement and spacing between the left and right main speakers LMS and RMS, relative to their respective left and right sub-speakers LSS and RSS is in accordance with parent application Ser. No. 10/692,692, FIG. 20. Although the left and right front speakers LFS and RFS are shown located between the respective combinations of main and sub-speakers, it will be apparent to anyone skilled in the art that the front speakers may be placed in any location more or less symmetrical to the locations of the main and sub-speakers.

Front to back filters 101 and 102 perform the same function described in parent application Ser. No. 10/692,692, for the signals reproduced by the left and right main speakers LMS and RMS. Front to back filter 103, performs the same function for the signals reproduced by the left and right sub-speakers LSS and RSS. Circuit components C4, C5, C6, C7, L1 and L2 perform various of the filtering functions also described in parent application Ser. No. 10/692,692. Circuit components C1, C2, C3, R1 and R2 have been added in such a way as to change the relative level and frequency response of the two signal components comprising the difference signals applied to left and right sub-speakers LSS and RSS such that the signals components will not cancel each other and such that the difference signal applied to the sub-speakers will always be substantially non-zero.

By way of example and not of limitation, the positive right surround signal RS passes through capacitor C5 and inductor L2 and is then applied to the negative terminal of the left sub-speaker LSS, causing the left sub-speaker to reproduce an inverted and modified version of the right surround signal RS'''. After passing through the left sub-speaker LSS the modified right surround signal is divided between two paths. A portion of the signal current flows through resistor R1 and a portion through capacitor C1, back to the negative terminal of the right surround signal RS source. The remaining portion of the right surround signal current flows through front-to-back filter 103 and capacitor C3. It is then divided again between two paths with a portion of the current flowing through resistor R2 and capacitor C2 back to the negative terminal of the left surround signal LS source. The remaining portion of the right surround signal current is applied to the positive terminal of the right sub-speaker RSS, and then flows through inductor L1 and capacitor C4 back to the positive terminal of the left surround signal LS source. As is well known, multi-channel audio amplifiers typically share a common ground between all channels. For the purposes of this analysis the negative terminals of all the signal inputs may, therefore, be considered connected. It is also well understood that the output circuitry of most audio amplifiers appears as a short circuit to any externally applied signal. For example, in this embodiment of the present invention, some portion of the right surround signal RS is applied to the positive terminal of the left surround signal LS source where it will flow as if directly connected to the negative terminal which may, in turn, be considered as directly connected to the negative terminal of the right surround signal RS source. As can be seen by inspection, the remaining portion of the right surround signal RS applied to the positive terminal of the right sub-speaker RSS, causes right sub-speaker RSS to reproduce an in-phase version of the right surround signal RS'', which will be reduced in level and have a different frequency response as compared to the inverted version of the right surround signal RS''' being reproduced by the left sub-speaker LSS. A similar analysis may be made for the current flows originating from the left surround signal LS.

FIG. 4*a* shows the relative magnitude and frequency response of the modified versions of the right surround signal RS', RS'' and inverted RS''' as reproduced by the right main speaker RMS, right sub-speaker RSS, and left sub-speaker LSS, respectively. The signals originating from the left surround signal LS are LS', LS'' and LS''' and will have the same magnitude and frequency response as shown for signals RS', RS'' and RS''' respectively and will be reproduced by the left main speaker LMS, left sub-speaker LSS, and right sub-speaker RSS, respectively. As shown in FIG. 4 the signal applied to the right sub-speaker RSS is composed of RS'' plus the inverted LS''', as indicated by the minus sign. Since LS''' will have the same frequency response and magnitude as RS''', and since RS''' has a different frequency response and magnitude than RS'', the combination of RS'' minus LS''' will be non-zero even when the right and left surround signals RS and LS are the same. Similarly, the combination of LS'' minus RS''' applied to the left sub-speaker LSS will also be non-zero. Therefore, the device will continue to function properly for surround sound encoding schemes which employ a monaural signal for both surround channels such as Dolby® Pro-Logic®. It has been determined experimentally that the device is most effective when a non-zero difference signal is maintained in the frequency range of approximately 200 Hz to 2 kHz. In this specific implementation of this third embodiment of the present invention, the components have approximately the following values:

C1 and C2—27 uf
R1 and R2—5.6 ohms
L1 and L2—0.75 mh
C4 and C5—180 uf
C6 and C7—330 uf
C3—220 uf In addition, front to back filters, 101, 102 and 103 are composed of an inductor, a capacitor and a resistor connected in parallel wherein the component values are approximately:

L—0.35 mh
C—4 uf
R—15 ohms

FIGS. 4 and 5 also show another aspect of the present invention. As discussed above, multi-channel audio amplifiers typically are of the common ground type where all channels share a common ground to which the negative terminals of all the channel outputs are connected. In rare cases, such as bridged amplifiers or systems with each amplifier on a separate chassis, the individual channels do not share a common ground. In this case, damage to the amplifiers may result if DC current is allowed to flow from one channel output to another. Referring to FIG. 4 it may be seen that for a portion of the right and left surround signals RS or LS, the left and right sub-speakers LSS and RSS are effectively connected in series across the positive output terminals of the left and right surround signal sources. In the absence of some form of isolation DC current would flow from one surround channel to the other. In this arrangement, with sub-speakers connected in series, a single capacitor C3 accomplishes the goal of isolating the two channels from each other by blocking the flow of DC current.

This is a substantial improvement over the prior art methods disclosed in U.S. Pat. Nos. 4,638,505 and 4,759,066 to Polk. Both of these patents describe methods for isolating the amplifier channels and optimizing bass response of the sub-speakers. In FIG. 2 of the '066 patent, an arrangement showing the sub-speakers partially connected in series is shown with channel isolation and bass response optimization accomplished using a single transformer. This arrangement has been used successfully in a consumer product, the Polk Audio SRT home theater speaker system. However, the transformer required for the system to operate properly without significant signal degradation was very costly and weighed over 10 lbs. Since that time, additional research has shown that bass response optimization for the sub-speakers is not necessary for the achievement of stable phantom sound images either front or rear located. In the present invention and as shown in FIG. 4, isolation of the amplifier channels is accomplished with the single low cost capacitor C3, with virtually no signal degradation.

Referring to FIG. 5 a simplified implementation of this aspect of the current invention is shown in a system employing sub-speakers receiving a difference signal to create and expanded sound stage from front channel or stereo signals such as disclosed in U.S. Pat. Nos. 4,489,432, 4,497,064 and 4,569,074, all to Polk. As shown in FIG. 5, isolation of the input channels is accomplished by capacitor C3. It has been determined experimentally that values for the isolation capacitor between approximately 100 uf and 300 uf produce good results. Other circuit components, C1, C2, R1 and R2 are used to alter the relative magnitude and frequency response of the components of the difference signals reproduced by the left and right sub-speakers LSS and RSS, as discussed in the description of the third embodiment above.

For the purpose of illustration but not of limitation, the various embodiments of the present invention have been discussed primarily as having either four input signals comprising two front channels and two rear channels, or as having just two front channel input signals. It will be immediately apparent to anyone skilled in the art that the methods of the present invention may applied to any single pair of input signals for the purpose of creating phantom sound images. Various unmodified input signals and corresponding drive units for reproducing them may also be added to any of the embodiments without departing from the spirit of the invention. By way of example and not of limitation, a front center channel signal, such as commonly found in surround sound systems, and speaker for reproducing same could be added to the embodiment shown in FIG. 4 so as to reproduce all of the full range channels of a 5.1 surround sound system from a single enclosure. Similarly, any number of additional unmodified input channels and speakers for reproducing them could be added to the embodiments while still remaining within the scope of the present invention. Also by way of example and not of limitation, the additional channels of a 6.1 or 7.1 surround sound system could be added. Additionally, it would be within the scope of this invention to apply the methods disclosed herein to multiple pairs of input signals within the same system. Further applications of the methods herein disclosed will be apparent to those skilled in the art.

What is claimed is:

1. An audio reproduction system comprising:

a first audio input signal and a second audio input signal;

a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers;

a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance from the respective left and right main speaker locations such that the distance is in the range from approximately 50% to 150% of the average spacing between a person's ears as measured in a straight line through the head, wherein said left and right sub-speakers reproduce sound associated with signals received by them; and signal modification and combination means, wherein said signal modification and combination means comprises, means for modifying and transmitting the first audio input signal to said left main speaker, means for modifying and transmitting the second audio input signal to said right main speaker, means for subtracting a modified version of the second audio input signal from a modified version of the first audio input signal and transmitting the resulting difference signal to said left sub-speaker, and means for subtracting a modified version of the first audio input signal from a modified version of the second audio input signal and transmitting the resulting difference signal to said right sub-speaker, wherein said signal modification means includes a time delay applied to one of said first or second audio input signals relative to the other of said first and second audio input signals, wherein sound reproduced by the system that is associated with said first and second audio input signals is perceived by a listener located in the listening area whose head is oriented generally toward the speaker locations to originate from a broad range of sound locations extending beyond the locations of said left and right sub-speakers.

2. The system of claim 1 wherein the time delay is approximately between 0.5 and 2.5 milliseconds.

3. The system of claim 1 wherein the time delay is approximately 1.5 milliseconds.

4. An audio reproduction system comprising:

a first audio input signal and a second audio input signal;

a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers;

a left sub-speaker and a right sub-speaker intended to be disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance from the respective left and right main speaker locations such that the distance is in the range from approximately 50% to 150% of the average spacing between a person's ears as measured in a straight line through the head, wherein said left and right sub-speakers reproduce sound associated with signals received by them; and signal modification and combination means, wherein said signal modification and combination means comprises, means for modifying and transmitting the first audio input signal to said left main speaker, means for modifying and transmitting the second audio input signal to said right main speaker, means for subtracting a modified version of the second audio input signal from a modified version of the first audio input signal and transmitting the resulting difference signal to said left sub-speaker, and means for subtracting a modified version of the first audio input signal from a modified version of the second audio input signal and transmitting the resulting difference signal to said right sub-speaker, and means for altering the relative magnitude and frequency response of the two components of the difference signals transmitted to each of the right and left sub-speakers such that said difference signals are substantially non-zero when said first and second input signals are the same, wherein sound reproduced by the system that is associated with said first and second audio input signals is perceived by a listener located in the listening area whose head is oriented generally toward the speaker locations to originate from a broad range of sound locations extending beyond the locations of said left and right sub-speakers.

5. The system of claim 4 wherein the difference signals transmitted to each of the sub-speakers is substantially non-zero in the frequency range of approximately 200 Hz to 2 kHz when said first and second input signals are the same.

6. The system of claim 4 wherein the in-phase component of the difference signals transmitted to each of the sub-speakers is attenuated by an average of more than 3 db relative to the inverted component of that same difference signal.

7. The system of claim 4, further comprising:

a third audio input signal and a fourth audio input signal;

a left front speaker and a right front speaker disposed respectively at left and right front speaker locations, wherein said left and right front speakers reproduce sound associated with signals received by said left and right front speakers;

means for transmitting the third audio input signal to said left front speaker, and means for transmitting the fourth audio input signal to said right front speaker.

8. The system of claim 7, wherein the left and right main speakers, the left and right sub-speakers and the left and right front speakers are mounted in a single enclosure.

9. The system of claim 7, further comprising:

a fifth audio input signal;

a center speaker disposed at a center speaker location approximately centered between said left and right front speakers locations, wherein said center speaker reproduces sounds associated with signals received by said center speaker; and means for transmitting the fifth audio input signal to said center speaker.

10. The system of claim 9, wherein the left and right main speakers, left and right sub-speakers, left and right front speakers and center speaker are all mounted in a single enclosure.

11. The system of claim 7, wherein said left and right front speaker locations are approximately symmetrically spaced with respect to said respective left and right main and sub-speaker locations.

12. An audio reproduction system comprising:

a first audio input signal and a second audio input signal;

a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers;

a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance from the respective left and right main speaker locations such that the distance is in the range from approximately 50% to 150% of the average spacing between a person's ears as measured in a straight line through the head, wherein said left and right sub-speakers reproduce sound associated with signals received by them; and signal modification and combination means, wherein said signal modification and combination means comprises, means for modifying and transmitting the first audio input signal to said left main speaker, means for modifying and transmitting the second audio input signal to said right main speaker, means for subtracting a modified version of the second audio input signal from a modified version of the first audio input signal and transmitting the resulting difference signal to said left sub-speaker, and means for subtracting a modified version of the first audio input signal from a modified version of the second audio input signal and transmitting the resulting difference signal to said right sub-speaker, wherein said first and second sub-speakers are connected substantially in series such that a portion of each of said first and second input signals flows through both sub-speakers in series fashion, wherein all of that portion of each of said first and second input signals flows through an isolation capacitor connected substantially in series with and between the left and right sub-speakers, wherein sound reproduced by the system that is associated with said first and second audio input signals is perceived by a listener located in the listening area whose head is oriented generally toward the speaker locations to originate from a broad range of sound locations extending beyond the locations of said left and right sub-speakers.

13. The system of claim 12 wherein the isolation capacitor has a value in the range of approximately 100 uf to 300 uf.

14. An audio reproduction system comprising:

a first audio input signal and a second audio input signal;

a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers;

a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance from the respective left and right main speaker locations such that the distance is in the range from approximately 50% to 150% of the average spacing between a person's ears as measured in a straight line through the head, wherein said left and right sub-speakers reproduce sound associated with signals received by them; and signal modification and combination means, wherein said signal modification and combination means comprises, means for subtracting a modified version of the second audio input signal from the first audio input signal and transmitting the resulting difference signal to said left main speaker, means for subtracting a modified version of the first audio input signal from the second audio input signal and transmitting the resulting difference signal to said right main speaker, means for subtracting a modified version of the second audio input signal from a modified version of the first audio input signal and transmitting the resulting difference signal to said left sub-speaker, and means for subtracting a modified version of the first audio input signal from a modified version of the second audio input signal and transmitting the resulting difference signal to said right sub-speaker, wherein sound reproduced by the system that is associated with said first and second audio input signals is perceived by a listener located in the listening area whose head is oriented generally toward the speaker locations to originate from a broad range of sound locations extending beyond the locations of said left and right sub-speakers.

15. The system of claim 14 wherein the inverted components of the difference signals transmitted to the left and right main are attenuated by more than 4 db.

* * * * *